US008864118B2

(12) United States Patent
Frank

(10) Patent No.: US 8,864,118 B2
(45) Date of Patent: Oct. 21, 2014

(54) STABILIZING DEVICE

(75) Inventor: Oliver Frank, Siegsdorf (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 342 days.

(21) Appl. No.: 12/936,847

(22) PCT Filed: Mar. 18, 2009

(86) PCT No.: PCT/EP2009/001976

§ 371 (c)(1),
(2), (4) Date: Dec. 30, 2010

(87) PCT Pub. No.: WO2009/124641

PCT Pub. Date: Oct. 15, 2009

(65) Prior Publication Data

US 2011/0094488 A1 Apr. 28, 2011

(30) Foreign Application Priority Data

Apr. 8, 2008 (DE) ..... 10 2008 017 926

(51) Int. Cl.
*F41A 27/30* (2006.01)
*F41A 25/12* (2006.01)

(52) U.S. Cl.
CPC ..... *F41A 25/12* (2013.01)
USPC ..... 267/166; 267/136

(58) Field of Classification Search
USPC ..... 267/166, 167, 169, 136, 140.11, 286, 267/289; 188/278, 82.84, 82.8, 67, 381; 464/162; 403/109.3, DIG. 6; 192/110 R, 192/150
See application file for complete search history.

(56) References Cited

U.S. PATENT DOCUMENTS

| | | | | |
|---|---|---|---|---|
| 2,989,968 | A * | 6/1961 | Vogel | 135/75 |
| 4,385,849 | A * | 5/1983 | Crain | 403/109.3 |
| 5,480,015 | A * | 1/1996 | Yang | 192/56.1 |
| 6,325,188 | B1 * | 12/2001 | Wu | 188/381 |
| 6,854,916 | B2 * | 2/2005 | Hsieh | 403/109.3 |
| 8,210,580 | B2 * | 7/2012 | Engel et al. | 292/252 |

FOREIGN PATENT DOCUMENTS

| | | | |
|---|---|---|---|
| DE | 100 24 320 | A1 | 11/2001 |
| DE | 20 2005 011 008 | U1 | 12/2005 |

OTHER PUBLICATIONS

Polycal, Half-Helical or Helical, http://www.socitec.fr/, Socitec Vibrations, pp. 1-5.
International Search Report issued in corresponding European Application No. PCT/EP2009/001976, dated Jul. 14, 2009, completed Jul. 21, 2009.
Webster's New Collegiate Dictionary 280, 507 and 840 (1977).
Espacenet—Bibliographic data English Abstract, last updated Mar. 13, 2013, corresponding to DE 20 2005 011 008 U1, filed herewith as Exhibit A.

* cited by examiner

*Primary Examiner* — Anna Momper
(74) *Attorney, Agent, or Firm* — Griffin & Szipl, P.C.

(57) ABSTRACT

A device for stabilizing a launcher, in particular during the firing of camouflage bodies and decoy flares or other systems in which vibrations can build up, thereby subjecting them to shocks. The device is a stabilizer (4) provided on a known damping system (1), for example a metal cable damper etc., into which a re-adjustable system (10), consisting of a rod (11) provided with a curved portion or groove, a pre-loaded device (12), a type of pressure part (13) and a type of pawl part (14), is placed. Pressure can be exerted on the curved portion of the rod (11) by the pre-loaded device (12) using the pressure part (13) and pawl part (14).

19 Claims, 3 Drawing Sheets

Fig. 2
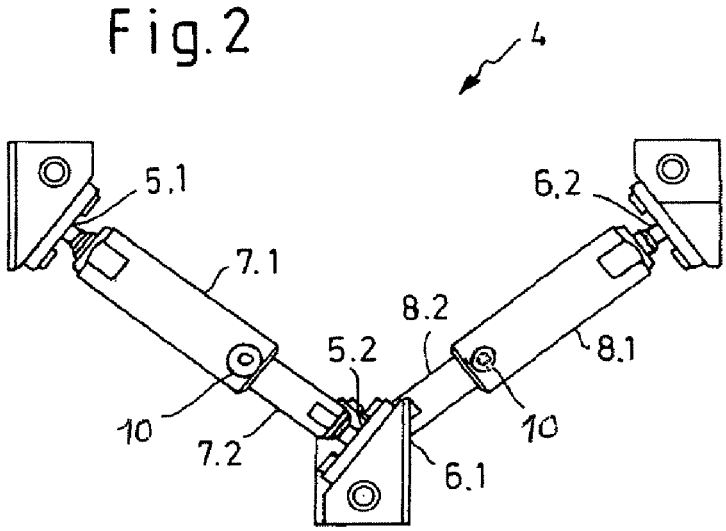
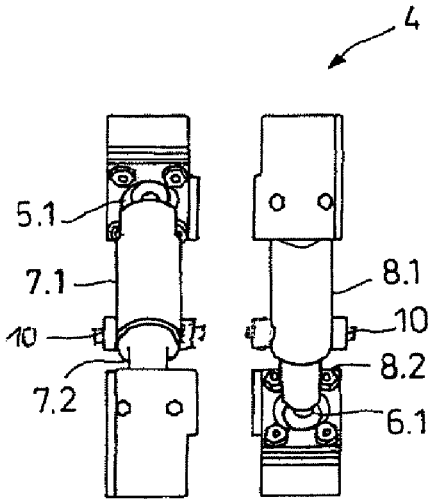
Fig. 2a

STABILIZING DEVICE

This is a National Phase Application in the United States of International Patent Application No. PCT/EP2009/001976 filed Mar. 18, 2009, which claims priority on German Patent Application No. 10 2008 017 926.4, filed Apr. 8, 2008. The entire disclosures of the above patent applications are hereby incorporated by reference.

FIELD OF THE INVENTION

The invention relates to a device for stabilizing a launcher, in particular while firing camouflage bodies and decoys, or other installations which can oscillate, and in particular in the case of a launcher which can in consequence carry out its function with respect to aiming reliability and accurately only to a limited extent.

BACKGROUND OF THE INVENTION

By way of example, DE 100 24 320 A1 discloses a radar device for object protection, which has a firing container. Firing containers such as these, or launchers, are subject to the problem of oscillation, at least while in use. The stabilization of launchers while the load in use is applied, taking account of the shock comparability, in this case, however, represents a technical problem. Many launchers and associated switching cabinets are damped by metal cable dampers, or the like. However, these measures are often not sufficient to prevent oscillation, for example, as a result of firing sequences.

Dampers such as these are marketed, for example, by the Socitec Company, inter alia in the product ranges Polycal, Half-Helical or Helical (http://www.socitec.fr/).

Even if the use of a disruptive damping element is considered, this has the disadvantage that a factor of 5 or more is generally required in order to significantly increase the stiffness of the system. This then leads to a very high residual shock, which cannot be absorbed by the system. Because of the unpredictable firing sequences, the launcher can still oscillate at the natural frequency, as a result of which it is still possible for intolerable discrepancies to occur in the firing angle.

DE 20 2005 011 008 U1 discloses a further stabilizing device in particular for a launcher, which is distinguished in that stabilization is provided in addition to a known damper system, for example, a metal cable damper etc., and is held together at least by a shear bolt. The bolt shears off after or with a shock effect, and the damper system can absorb the shock. The stabilization and the associated design are, in this case, able to move freely in all directions so that, despite the shear bolts, no parts will fly off, the structure remains intact in its function, and only the bolt is retrofitted. In one particular embodiment, the solution allows the launcher to be fixed for the operating load (firing, movement), the damping movement to be provided in the event of a shock, in order to avoid overloading of the installation, and recreation of the stiff state after a shock, by simple means.

The object of the invention is therefore to specify a further simple design option for counteracting oscillation when subject to the load when in use.

SUMMARY OF THE INVENTION

The object of the present invention is achieved by the features of a first embodiment, which pertains to a stabilizing device (4) for a launcher or other installations, which are subject to shock effects and are provided with a damping system (1), wherein the stabilizing device (4) has ball joints (5.1, 5.2; 6.1, 6.2) at each of at least two attachment points to the damping system (1), between which ball joints (5.1, 5.2; 6.1, 6.2) at least two tubes (7.1, 7.2; 8.1, 8.2), which run into one another, are included, wherein the damping system (1) is characterized in that a readjustable adjustable system (10) is placed in the tubes (7.1, 7.2; 8.1, 8.2), wherein the readjustable system (10) comprises a rod (11) having a curved or grooved portion, a prestressed device (12), a type of pressure piece (13) and a type of catch piece (14), wherein the prestressed device (12) can exert a pressure on the rod (11) via the pressure piece (13) and the catch piece (14).

The invention is based on the idea of providing a readjustable adjustable stabilization by means of which the initiation force can be adapted more individually. The appliance and the installation, which can be mounted on the stabilization device, are automatically moved back to their original position again after a mine shock or the like, and there is no need for notification or replacement of parts.

Advantageous embodiments are contained in the description that follows. For example, in accordance with a second embodiment of the present invention, the first embodiment is modified so that the damping system (1) consists of two strips (3), which are functionally connected to one another by metal springs (2).

The initial structure, in accordance with the present invention, is a damper that is installed between two strips, or the like, for example, a metal cable damper, with ball joints included at the attachment points, preferably two ball joints, which ensure that the structure can move freely over an angle in a known manner. In one simple embodiment, by way of example, two tubes, which preferably run into one another (i.e., telescopic tubes), are integrated on these ball joints. In accordance with principles of the present invention, these tubes may be adjustable. In the preferred embodiment, two tube pairs are used, which can be moved into one another.

According to the invention, a readjustable adjustable device or system is fitted in the stabilization device, in this case into the tube pairs. This system primarily consists of a rod provided with a curved portion or groove formed therein, a cup spring pack or some other prestressed device by means of which pressure can be exerted on the curved portion of the rod via a type of pressure piece and a type of catch piece. In the case of an axial force, which can act in both directions, the force is introduced into the cup spring pack via the curve inclines of the curved portion or groove, via the catch piece and the pressure piece.

The system itself is moved only after prestressing of the springs of the damper is exceeded. When this occurs, the catch piece is moved at right angles to the axial force, and releases the curved portion or groove of the rod. This makes it possible for a wire cable spring damper equipped with this system to move freely after initiation, and allows it to accommodate for example over 45 mm, in all directions. The system starts to oscillate and the catch piece passes over the curve in the curved portion or groove of the rod a number of times. As long as the energy of motion is sufficiently great, the installation will continue to oscillate. When the energy of motion falls below a specific limit, the catch piece finally latches in again, and fixes the installation in the original position. The capability of the system itself to move in all directions is ensured by the ball joints.

Furthermore, one major advantage of this simple solution is that it can be retrofitted to already existing installations and launch systems.

Furthermore, the overall structure can be used in switching cabinets or other appliances, which have damping systems of this type in a similar manner, and can be equipped or retrofitted with stabilization assemblies.

BRIEF DESCRIPTION OF THE DRAWINGS

The invention will be explained in more detail below, using one exemplary embodiment and with reference to the drawings, in which:

FIG. 2 shows a side view of the stabilizing device shown in FIG. 1.

FIG. 2*a* shows a plan view of the stabilizing device shown in FIG. 2.

DETAILED DESCRIPTION OF THE INVENTION

Figure 1:
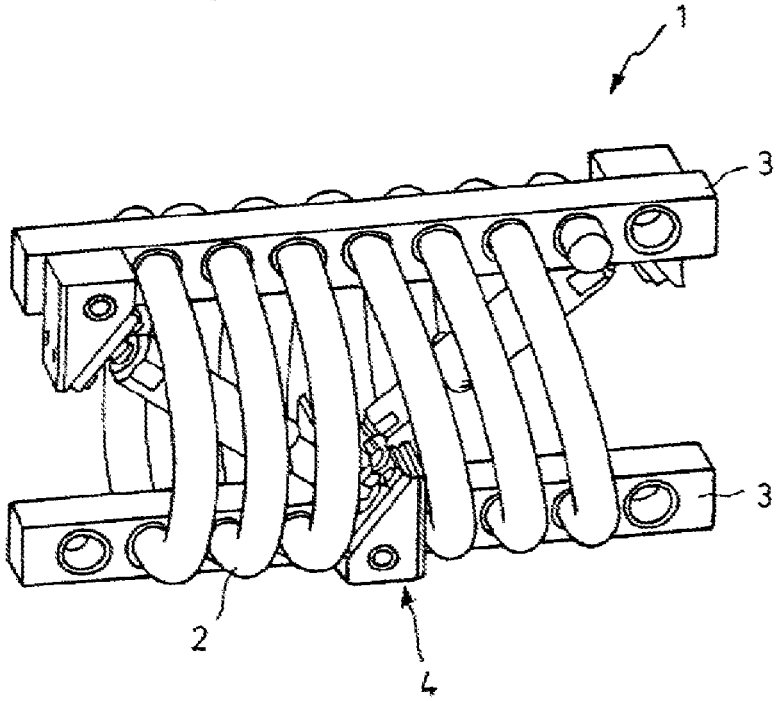
FIG. 1 shows a perspective illustration of a metal cable damper associated with a stabilizing device in accordance with the present invention.

By way of example, FIG. 1 shows a metal cable damper 1 that is used, for example, to damp oscillations of a launcher, which is not shown in any more detail here. This damper or damping system 1, in this exemplary embodiment, consists of two struts or strips 3 that are connected to one another via metal springs 2. A stabilizing device 4 is included between the strips 3 and the metal springs 2 and, in each case, has two ball joints 5.1, 5.2, 6.1, 6.2 at the attachment points for connection to the damper 1, which ensures that the device 4 can move freely over an angle. Two tubes 7.1, 7.2 and 8.1, 8.2, which can be adjusted and run into one another (i.e., are telescoping), are preferably attached to these ball joints 5.1, 5.2 and 6.1, 6.2 (See FIGS. 2, 2*a*).

Figure 3:
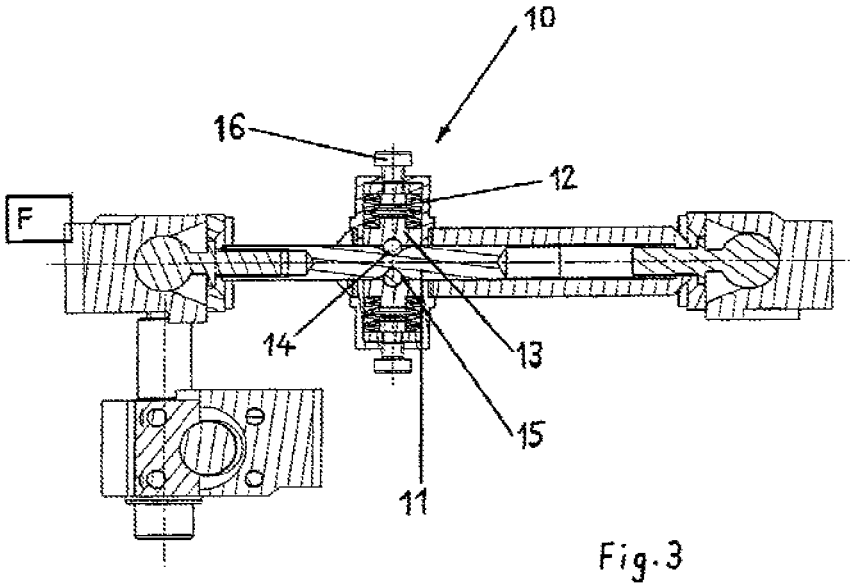
FIG. 3 shows an illustration of the readjustable system of the stabilizing device.

A readjustable adjustable device, or a readjustable adjustable system 10, is included in these tube pairs 7, 8, or in this stabilizing device 4. This system 10 primarily consists of a rod 11 provided with a curved portion or groove 15, a cup spring pack 12 or some other prestressed apparatus, by means of which a pressure can be exerted on the curved portion 15 of the rod 11 via a type of pressure piece 13 and a type of catch piece 14 (See FIG. 3). The device can be prestressed by an adjusting screw 16.

The system 10 itself is moved only when the prestressing of the springs of the damper 1 is exceeded. The catch piece 14 is, in this case, moved at right angles to the axial force, and releases the curved portion 15 of the rod 11. The system 10 starts to oscillate, and the catch piece 14 follows the curve of the curved portion 15 in the rod 11 a number of times. When the energy of motion falls below a specific limit, the catch piece 14 finally latches in again, and fixes the installation (not shown in any more detail) in the original position (See. e.g., FIG. 3).

The invention claimed is:

1. A stabilizing device for a launcher or installation that is subject to shock effects and that is provided with a damping system, wherein the stabilizing device comprises:

(a) a plurality of ball joints disposed at each of at least two attachment points to the damping system, wherein between the ball joints at least two telescoping tubes extend, wherein the at least two telescoping tubes run telescopically into one another; and (b) a readjustable adjustable system is placed in the at least two telescoping tubes, wherein the readjustable adjustable system comprises i. a rod including a curved portion formed in the rod;

ii. a prestressed device;

iii. a pressure piece; and iv. a catch piece, wherein the prestressed device is disposed to exert pressure on the curved portion of the rod via the pressure piece and the catch piece, and wherein the catch piece is disposed to follow a curve of the curved portion formed in the rod, and the catch piece is movable at right angles to the rod so as to release the rod when an axial force on the rod exceeds the pressure exerted by the prestressed device.

2. The stabilizing device as claimed in claim 1, wherein the damping system consists of two strips that are functionally connected to one another by metal springs.

3. The stabilizing device as claimed in claim 1, wherein the damping system comprises two strips that are functionally connected to one another by metal springs.

4. The stabilizing device as claimed in claim 1, wherein the curved portion formed in the rod is a curved groove formed in the rod.

5. The stabilizing device as claimed in claim 1, wherein the rod extends into each of the at least two telescopic tubes.

6. The stabilizing device as claimed in claim 1, wherein the rod is fully enclosed inside the at least two telescoping tubes.

7. The stabilizing device as claimed in claim 1, wherein the pressure piece is in direct contact with the catch piece.

8. An installation provided with a damping system to dampen shock effects, wherein a stabilizing device is connected to the damping system, wherein the stabilizing device comprises:

(a) a plurality of ball joints disposed at each of at least two attachment points to the damping system, wherein between the ball joints at least two telescoping tubes extend, wherein the at least two telescoping tubes run telescopically into one another; and (b) a readjustable adjustable system is placed in the at least two telescoping tubes, wherein the readjustable adjustable system comprises i. a rod including a curved portion formed in the rod;

ii. a prestressed device;

iii. a pressure piece; and iv. a catch piece, wherein the prestressed device is disposed to exert pressure on the curved portion of the rod via the pressure piece and the catch piece, and wherein the catch piece is disposed to follow a curve of the curved portion formed in the rod, and the catch piece is movable at right angles to the rod so as to release the rod when an axial force on the rod exceeds the pressure exerted by the prestressed device.

9. The installation as claimed in claim 8, wherein the damping system consists of two strips that are functionally connected to one another by metal springs.

10. The installation as claimed in claim 8, wherein the damping system comprises two strips that are functionally connected to one another by metal springs.

11. The installation as claimed in claim 8, wherein the installation is a launcher.

12. The installation as claimed in claim 8, wherein the curved portion formed in the rod is a curved groove formed in the rod.

13. The stabilizing device as claimed in claim 8, wherein the rod extends into each of the at least two telescopic tubes.

14. The stabilizing device as claimed in claim 8, wherein the rod is fully enclosed inside the at least two telescoping tubes.

15. The stabilizing device as claimed in claim 8, wherein the pressure piece is in direct contact with the catch piece.

16. A stabilizing device for a launcher or installation that is subject to shock effects and that is provided with a damping system, wherein the stabilizing device comprises:

(a) a plurality of ball joints disposed at each of at least two attachment points to the damping system, wherein between the ball joints at least two telescoping tubes extend, wherein the at least two telescoping tubes run telescopically into one another; and (b) a readjustable adjustable system is placed in the at least two telescoping tubes, wherein the readjustable adjustable system comprises i. a rod including a curved portion formed in the rod, wherein the curved portion includes a curved groove formed in the rod;

ii. a prestressed device;

iii. a pressure piece; and iv. a catch piece, wherein the prestressed device is disposed to exert pressure on the curved portion of the rod via the pressure piece and the catch piece, and wherein the catch piece is disposed in the curved groove to follow a curve of the curved portion formed in the rod, and the catch piece is movable at right angles to the rod so as to release the rod when an axial force on the rod exceeds the pressure exerted by the prestressed device.

17. A launcher provided with a damping system to dampen shock effects, wherein a stabilizing device is connected to the damping system, wherein the stabilizing device comprises:

(a) a plurality of ball joints disposed at each of at least two attachment points to the damping system, wherein between the ball joints at least two telescoping tubes extend, wherein the at least two telescoping tubes run telescopically into one another; and (b) a readjustable adjustable system is placed in the at least two telescoping tubes, wherein the readjustable adjustable system comprises i. a rod including a curved portion formed in the rod, wherein the curved portion includes a curved groove formed in the rod;

ii. a prestressed device;

iii. a pressure piece; and iv. a catch piece, wherein the prestressed device is disposed to exert pressure on the curved portion of the rod via the pressure piece and the catch piece, and wherein the catch piece is disposed in the curved groove to follow a curve of the curved portion formed in the rod, and the catch piece is movable at right angles to the rod so as to release the rod when an axial force on the rod exceeds the pressure exerted by the prestressed device.

18. A launcher provided with a damping system to dampen shock effects, wherein a stabilizing device is connected to the damping system, wherein the stabilizing device comprises:

(a) a plurality of ball joints disposed at each of at least two attachment points to the damping system, wherein between the ball joints at least two telescoping tubes extend, wherein the at least two telescoping tubes run telescopically into one another; and (b) a readjustable adjustable system is placed in the at least two telescoping tubes, wherein the readjustable adjustable system comprises i. a rod including a curved portion formed in the rod, wherein the curved portion includes a curved groove formed in the rod;

ii. a prestressed device;

iii. a pressure piece; and iv. a catch piece, wherein the prestressed device is disposed to exert pressure on the curved portion of the rod via the pressure piece and the catch piece, and wherein the catch piece is disposed in the curved groove to follow a curve of the curved portion formed in the rod, and the catch piece is movable at right angles to the rod so as to release the rod when an axial force on the rod exceeds the pressure exerted by the prestressed device, wherein when the axial force on the rod exceeds the pressure exerted by the prestressed device, and the catch piece moves from a first position in the curved groove to a second position on the curved rod so as to release the rod, the catch piece continues to follow the curve of the curved portion of the rod in an oscillatory manner until the energy of motion falls below a preset limit and the catch piece latches again in the first position.

19. A stabilizing device for a launcher or installation that is subject to shock effects and that is provided with a damping system, wherein the stabilizing device comprises:

(a) a plurality of ball joints disposed at each of at least two attachment points to the damping system, wherein between the ball joints at least two telescoping tubes extend, wherein the at least two telescoping tubes run telescopically into one another; and (b) a readjustable adjustable system is placed in the at least two telescoping tubes, wherein the readjustable adjustable system comprises i. a rod including a curved portion formed in the rod, wherein the curved portion includes a curved groove formed in the rod;

ii. a prestressed device;

iii. a pressure piece; and iv. a catch piece, wherein the prestressed device is disposed to exert pressure on the curved portion of the rod via the pressure piece and the catch piece, and wherein the catch piece is disposed in the curved groove to follow a curve of the curved portion formed in the rod, and the catch piece is movable at right angles to the rod so as to release the rod when an axial force on the rod exceeds the pressure exerted by the prestressed device, wherein when the axial force on the rod exceeds the pressure exerted by the prestressed device, and the catch piece moves from a first position in the curved groove to a second position on the curved rod so as to release the rod, the catch piece continues to follow the curve of the curved portion of the rod in an oscillatory manner until the energy of motion falls below a preset limit and the catch piece latches again in the first position.

* * * * *